US005507272A

United States Patent [19]

Scantlen

[11] Patent Number: 5,507,272

[45] Date of Patent: Apr. 16, 1996

[54] ADJUSTABLE BOW SIGHT

[76] Inventor: Jayson R. Scantlen, 907 S. Walnut, Bryan, Ohio 43506

[21] Appl. No.: 292,883

[22] Filed: Aug. 19, 1994

[51] Int. Cl.[6] ..... F41G 1/467

[52] U.S. Cl. ..... 124/87; 33/265

[58] Field of Search ..... 124/86, 87; 33/265

[56] References Cited

U.S. PATENT DOCUMENTS

| | | | |
|---|---|---|---|
| 3,618,586 | 11/1971 | Current et al. . | |
| 3,849,894 | 11/1974 | Brougham | 33/265 |
| 4,481,717 | 11/1984 | Kowalski . | |
| 4,535,747 | 8/1985 | Kadlacek . | |
| 4,541,179 | 9/1985 | Closson . | |
| 4,584,777 | 4/1986 | Saunders | 124/87 X |
| 4,616,623 | 10/1986 | Williams . | |
| 4,669,194 | 6/1987 | Amacker . | |
| 4,757,614 | 7/1988 | Kudlacek . | |
| 4,875,290 | 10/1989 | Finch | 33/265 |
| 4,884,347 | 12/1989 | Larson | 124/87 X |
| 4,977,677 | 12/1990 | Troescher, Jr. . | |
| 5,025,565 | 6/1991 | Stenerson et al. . | |
| 5,050,576 | 9/1991 | Larson . | |
| 5,092,052 | 3/1992 | Godsey . | |
| 5,092,053 | 3/1992 | Roberts . | |
| 5,152,068 | 10/1992 | Meister et al. . | |
| 5,174,269 | 12/1992 | Sappington . | |
| 5,289,814 | 3/1994 | Maisano . | |

FOREIGN PATENT DOCUMENTS

| | | | |
|---|---|---|---|
| 1345697 | 11/1963 | France | 33/265 |
| 1026490 | 4/1966 | United Kingdom | 33/265 |

*Primary Examiner*—Anthony Knight
*Attorney, Agent, or Firm*—Marshall & Melhorn

[57] ABSTRACT

An adjustable bow sight including a sight frame removedly affixed to the bow by a mounting bracket. An elongated sight bar extends forwardly from the sight frame. The sight bar is vertically movable along slide rods within the sight frame by a threaded adjustment screw adapted for manual rotation by an adjustment knob. A visual scale indicative of vertical positioning of the sight bar is provided on the sight frame. A windage unit mounted at the forward end of the sight bar carries a laterally adjustable sighting unit through which the archer views the target.

10 Claims, 2 Drawing Sheets

ADJUSTABLE BOW SIGHT

BACKGROUND OF THE INVENTION

1. Field of the Invention

The present invention pertains broadly to a sighting device for attachment to an archery bow, and more particularly to such a device incorporating adjusting mechanism by which range and windage corrections can be made to accommodate different target distances and wind conditions.

2. Description of the Prior Art

As archery has become more popular over the years, increasingly sophisticated equipment has been developed for practicing the sport. Among the equipment are various types of sighting devices for mounting upon bows to increase the degree of accuracy with which an arrow is launched toward a target. As an arrow travels from the bow to the target it, of course, follows a trajectory influenced by a number of factors including gravity, arrow weight and velocity, and wind velocity and direction. The effect of these factors, in turn, is a function of the distance travelled by the arrow between the bow and the target. In order to enable a shooter to compensate for different shooting conditions and distances, adjustable sighting devices have been developed wherein the sighting element can be selectively moved vertically and horizontally relative to the bow. As adjusted, the devices during sighting take into account the degree of elevation and horizontal correction necessary to compensate for gravitational and wind effects when the arrow is launched.

Many sighting devices of different types have been proposed as can be seen in the various archery publications, as well as in prior to U.S. patents. In one such type of sighting device as disclosed in U.S. Pat. Nos. 5,174,269 and 5,289,814, for example, a mounting bracket affixed to the bow carries a mounting arm. The sighting device and adjusting mechanism therefore are carried upon the mounting arm some distance from the bow. These devices employ a sight pin or a plurality of sight pins as the viewing device for the archer. A sighting device employing a ring and cross-hair viewer mounted upon a lever and link adjusting mechanism is disclosed in U.S. Pat. No. 4,541,179.

The prior art devices as shown in the aforementioned patents perform satisfactorily. However, devices of the type shown in the latter patent tend to be more complex and relatively difficult to manufacture and maintain. Devices of the type disclosed in the former patents tend to be bulky and cumbersome to use due to the location of the entire adjusting and sighting mechanism at the remote or distal end of the mounting arm. More importantly, as the bow string is released and an arrow is launched, the bow snaps back to its unstressed position, creating a great deal of shock in the bow. This shock is transmitted and amplified through the mounting arm to the relatively massive sighting and adjusting device carried at its remote end. As a result, the devices tend to fail structurally after relatively short periods of use. Thus, while the devices may function very well, they are subject to frequent breakage.

SUMMARY OF THE INVENTION

In accordance with the present invention, there is provided an improved adjustable bow sight wherein a sight frame is removably carried by a mounting bracket affixed to a bow. An elongated sight bar extends forward from the sight frame. The sight bar is vertically movable along slide rods within the sight frame by means of a threaded adjustment screw adapted for manual rotation by an adjustment knob. A visual scale indicative of vertical positioning of the sight bar is provided on the sight frame. A windage unit mounted at the distal end of the sight bar carries a laterally adjustable hooded cross-hair sighting unit through which the archer views the target.

It is, therefore, a primary object of the invention to provide an improved adjustable sight device for use with archery bows.

Another object of the invention is to provide such a sight device which is relatively simple and inexpensive to manufacture.

Another object is to provide such a device which is compact and less cumbersome to use than prior art units.

Still another object is to provide an adjustable sight device which is durable and not subject to structural failure due to the shock occasioned by repeated launching of arrows.

Other objectives and advantages of the invention will become apparent during the course of the following description, when taken in conjunction with the accompanying drawings. dr

BRIEF DESCRIPTION OF THE DRAWINGS

In the drawings, wherein like numerals refer to like parts throughout.

DESCRIPTION OF THE PREFERRED EMBODIMENT

Figure 1:
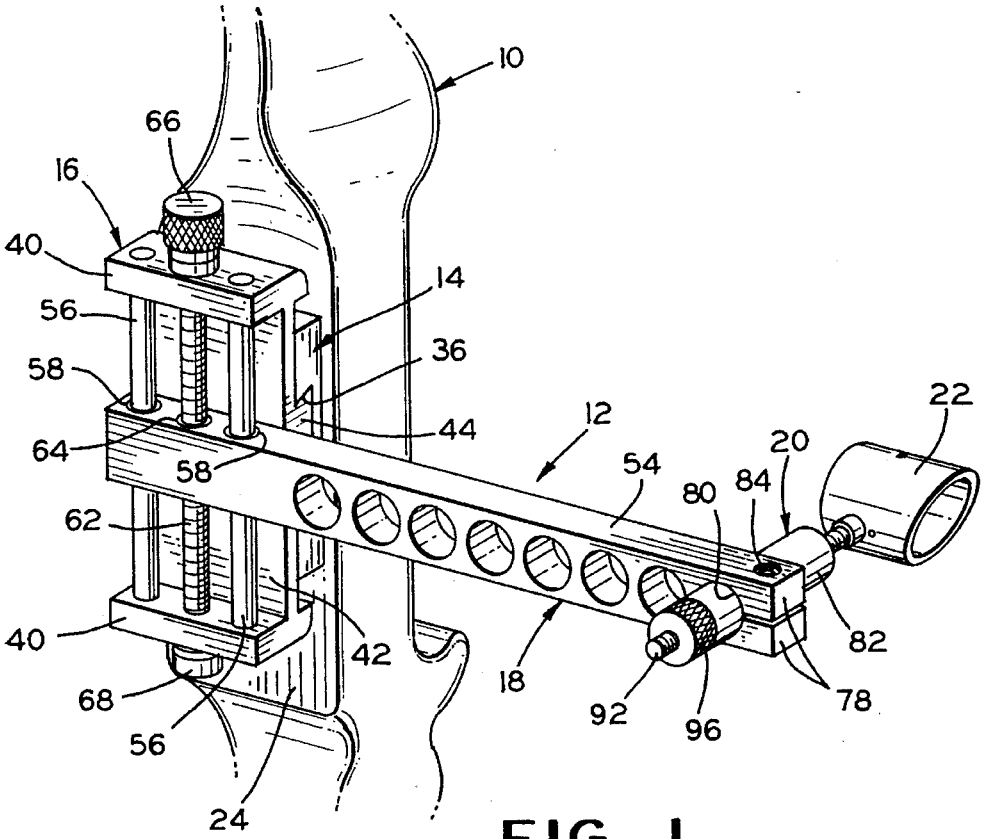
FIG. 1 is a fragmentary perspective view, from the front right, of a bow having an adjustable sight in accordance with the invention.

Referring now to the drawings, and particularly to FIG. 1, there is shown generally at 10 a portion of a bow upon which is mounted a sighting device 12 embodying the invention. The sighting device 12 more particularly includes a mounting bracket 14 affixed to the bow for receiving an adjusting sight frame 16. The sight frame adjustably carries a sight bar 18 upon which a windage unit 20 carrying a sighting element is mounted. In order to minimize weight, the various elements of the sighting device are preferably fabricated from a durable lightweight metal such as aluminum or a suitable alloy.

Figure 4:
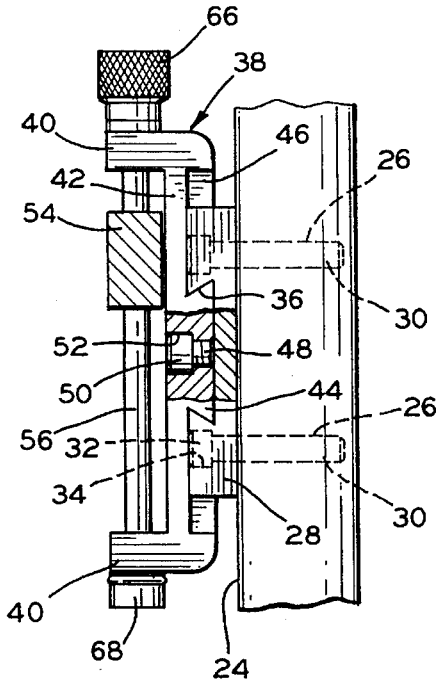
FIG. 4 is a front end view, partially in section, taken substantially along line 4—4 of FIG. 3.

For convenience in mounting any of various types of sights, present day bows are generally provided with a standardized planar mounting surface 24 and threaded inserts 26 for receiving mounting studs as will be explained. As best seen in FIGS. 1 and 4, the mounting bracket 14 is in the form of a generally rectangular block 28 secured on the mounting surface 29 by mounting studs 30 thread into the insert 26. The heads 32 of the mounting studs 30 are recessed within counter bores 34 in the block 28. A longitudinally extending dove-tailed slot 36 is provided in the outer surface of the block.

The adjusting frame 16 comprises a generally channel-shaped body 38 having opposite end flanges 40 interconnected by a web 42. A mating raised rib 44 on the rear of the web 42 is adapted to be slidingly received within the dove-tailed slot 36 for removably securing the body 38 to the mounting bracket 14. A flange 46 at one end of the web 42 is adapted to seat against the end of the block 28 with the sight frame 16 fully assembled on the mounting bracket 14. A set screw 48 threaded through the web 42 and the raised rib 44 is adapted to be turned down so that its end engages the block 28 within the base of the dove-tailed slot 36 to secure the adjusting frame on the mounting bracket. The head 50 of the setscrew is recessed within a counter bore 52 in the web 42 when the setscrew is tightened down to avoid interference with operation of the adjusting mechanism and the sight bar 18 as will be hereinafter described.

The sight bar 18 more particularly comprises an elongated bar 54 of generally rectangular cross-section mounted at one end for adjustable up and down movement along the adjusting sight frame 16. To that end, spaced parallel way rods 56 extend between the opposite end flanges 40 of the channel-shaped body 38, and may be mounted as by press fitting into openings within the end flanges. The elongated bar 54 is mounted for sliding up and down movement along the way rods on bushings 58 fitted within openings extending through the bar. An adjustment screw unit, shown generally at 60, is provided intermediate the way rods for incrementally moving the bar 54 to selected positions along the way rods.

Figure 3:
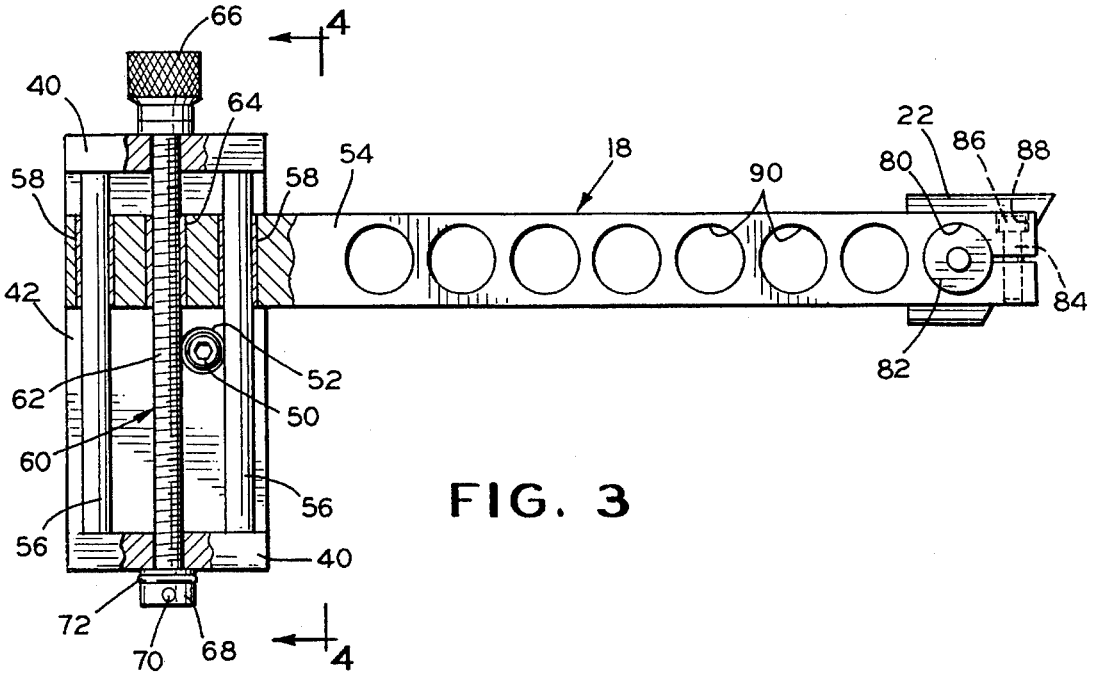
FIG. 3 is a side view, partially in section, of the adjustable sight.

The adjustment screw unit more particularly includes a threaded lead screw 62 extending through and mounted for rotation about its longitudinal axis, within the opposite end flanges 40 of the body 38. The lead screw is threaded through a bushing 64 extending through and affixed within the bar 54. An adjusting knob 66 affixed to the lead screw, by which the screw can be manually rotated, may include conventional axially spring loaded mechanism (not shown), releaseably engaging the knob at each half revolution to retain the lead screw at selected positions. As best seen in FIG. 3, a retainer cap 68 secured upon the lower end of the lead screw 62 as by a set screw 70, urges a resilient O-ring type washer 72 toward the end flange 40 to provide an axial spring loading effect against the knurled knob 66. Thus, by turning the knob to rotate the lead screw 62, the bar 54 can be moved up or down along the way rods 56 to selected positions.

Figure 2:
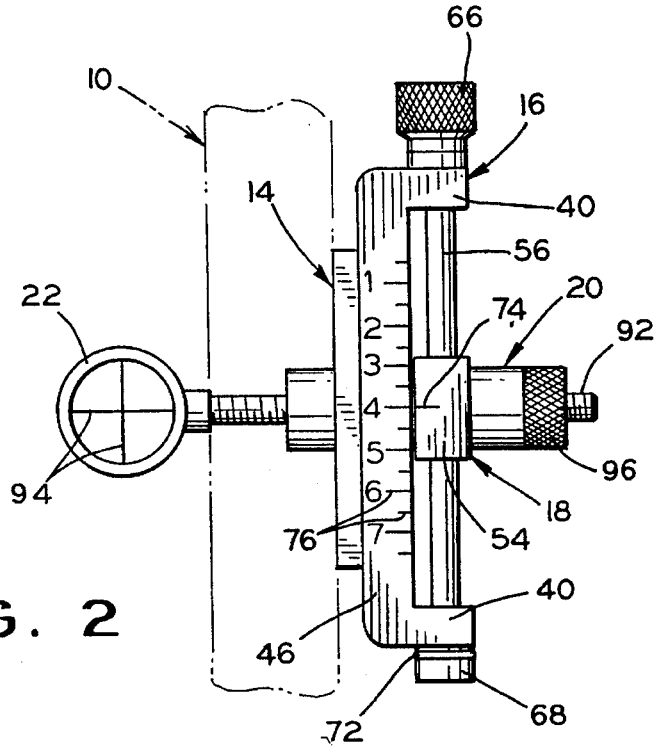
FIG. 2 is a rear end view, taken from the left in FIG. 1.

As will be seen in FIG. 2, in order to provide the archer with a visual indication of the vertical position of the sight bar 18, a reference mark 74 on the bar 54 cooperates with numbered scale marks 76 on the face of the flange 46. The distance between successive scale marks may, for example, correspond to one full turn of the knob 66.

In order to mount the windage unit 20, the elongated bar 54 is formed at its distal end with bifurcated legs 78 extending from a transverse opening 80 defined in the bar. The windage unit, which as heretofore indicated may be of conventional construction and does not form part of the present invention, includes a barrel section 82 adapted for reception with the opening 80. As best shown in FIG. 3, a clamping bolt 84 extending rotatably through an opening in the upper leg 78 and threaded into an opening in the lower leg 78, may be tightened down for drawing the bifurcated legs toward one another to clampingly secure the barrel section 82 within the opening 80. The head 86 of the bolt may be recessed within a counter bore 88 in the upper leg 78. For purposes of minimizing the weight of the sighting device, the bar 54 may be formed with a plurality of openings 84 spaced there along.

The windage unit 20 may conventionally include a threaded adjusting element 92 extending axially through the barrel section 20 and carrying at one end the sighting element or hood 22 having cross-hairs 94 therein. A knurled knob 96 is carried on the adjusting element 92 at the opposite end of the barrel section 82. By turning the knob 96 the sighting element or hood 22 can thus be adjusted to selected lateral positions as desired for making windage corrections.

It is to be understood that the form of the invention herewith shown and described is to be taken as an illustrative embodiment only of the same, and that various changes in the shape, size and arrangement of parts may be resorted to without departing from the spirit of the invention.

What is claimed is:

1. An adjustable sight for attachment to an archery bow, comprising a frame member adapted for mounting upon the bow, an elongated sight bar, said sight bar having proximal and distal ends, means mounting said sight bar at said proximal end upon the frame member for up and down movement to selected positions along the frame member, and a sighting unit at the distal end of the sight bar for visually aligning the bow with a target, and including a mounting bracket adapted to be mounted on the bow, and means releasably securing said frame member to said mounting bracket, wherein said means releasably securing said frame member to said mounting bracket comprises a dovetailed slot in either said mounting bracket or said frame member, and a mating raised rib on the other of said mounting bracket or said frame member, said frame member adapted to be slidingly received within the dovetailed slot, and means for releasably clamping the raised rib within the dovetailed slot.

2. An adjustable sight for attachment to an archery bow as claimed in claim 1, wherein said means mounting said sight bar comprises a way rod carried by said frame member, means mounting said sight bar for sliding back and forth movement along said way rod, and adjustment means operable between said frame member and said sight bar for moving said sight bar to selected positions along said way rod and said frame member.

3. An adjustable sight for attachment to an archery bow as claimed in claim 2, wherein said means mounting said sight bar comprises a spaced pair of said way rods, said way rods extending slidably through said sight bar, and said adjustment means comprises a lead screw.

4. An adjustable sight for attachment to an archery bow as claimed in claim 1, wherein said frame member comprises a channel-shaped body including opposite upper and lower flanges interconnected by a web section, and said means mounting said sight bar upon said frame member comprises a spaced pair of way rods extending between said upper and lower flanges, said way rods extending slidingly through said sight bar whereby said sight bar is adapted for sliding up and down movement along said way rods to selected positions along the frame member.

5. An adjustable sight for attachment to an archery bow as claimed in claim 4, including a lead screw extending threadably through said sight bar and journalled in said upper and lower flanges for rotation about its longitudinal axis for moving said sight bar along said way rods to said selected positions.

6. An adjustable sight for attachment to an archery bow as claimed in claim 5, including knob means on said lead screw for manually rotating said lead screw to move said sight bar.

7. An adjustable sight for attachment to an archery bow as claimed in claim 5, wherein said proximal end of said sight bar and said frame member include adjacent rearwardly facing surfaces, including a scale on said frame member surface and a reference mark on said sight bar surface adapted to move along said scale as said sight bar is moved to selected positions along the frame member.

8. An adjustable sight for attachment to an archery bow as claimed in claim 3, wherein said sighting unit at the distal end of said sight bar comprises a windage unit including a sighting element and means for adjusting the position of said sighting element laterally relative to said sight bar, and wherein the distal end of said sight bar terminates in a pair bifurcated legs extending from an opening through said sight bar, said windage unit being positioned within said opening, and including clamping means urging said bifurcated legs toward one another to clampingly engage said windage unit.

9. An adjustable sight for attachment to an archery bow, comprising a frame member adapted for mounting upon the bow, an elongated sight bar, said sight bar having proximal and distal ends, means mounting said sight bar at said proximal end upon the frame member for up and down movement to selected positions along the frame member, and a sighting unit at the distal end of the sight bar for visually aligning the bow with a target, and including a mounting bracket adapted to be mounted on the bow, and means releasably securing said frame member to said mounting bracket, wherein said frame member comprises a channel-shaped body including opposite upper and lower end flanges interconnected by a web section, a raised dovetail shaped rib on the rear of said web section, said mounting bracket having a mating dovetailed slot therein adapted to slidingly receive said raised rib for releasably securing said frame member to said mounting bracket.

10. An adjustable sight for attachment to an archery bow as claimed in claim 9, including a set screw threaded through said web and said raised rib and adapted to bear at its forward end against said bracket for releasably securing said raised rib against sliding movement within said slot.

* * * * *